US011488512B2

(12) United States Patent
Wang et al.

(10) Patent No.: US 11,488,512 B2
(45) Date of Patent: Nov. 1, 2022

(54) DISPLAY PANEL, DISPLAY DEVICE AND DISPLAY CONTROL METHOD THEREOF

(71) Applicants: ORDOS YUANSHENG OPTOELECTRONICS CO., LTD., Inner Mongolia (CN); BOE TECHNOLOGY GROUP CO., LTD., Beijing (CN)

(72) Inventors: Zhen Wang, Beijing (CN); Han Zhang, Beijing (CN); Zhengkui Wang, Beijing (CN); Wei Yan, Beijing (CN); Yun Qiao, Beijing (CN); Wenwen Qin, Beijing (CN); Xiaozhou Zhan, Beijing (CN); Jian Sun, Beijing (CN); Jian Zhang, Beijing (CN); Deshuai Wang, Beijing (CN)

(73) Assignees: Ordos Yuansheng Optoelectronics Co., Ltd., Inner Mongolia (CN); Beijing BOE Technology Development Co., Ltd., Beijing (CN)

( * ) Notice: Subject to any disclaimer, the term of this patent is extended or adjusted under 35 U.S.C. 154(b) by 342 days.

(21) Appl. No.: 16/714,385

(22) Filed: Dec. 13, 2019

(65) Prior Publication Data

US 2020/0242996 A1 Jul. 30, 2020

(30) Foreign Application Priority Data

Jan. 29, 2019 (CN) ..... 201910086820.X

(51) Int. Cl.
*G09G 3/20* (2006.01)

(52) U.S. Cl.
CPC ... *G09G 3/2074* (2013.01); *G09G 2300/0426* (2013.01); *G09G 2300/0452* (2013.01); *G09G 2310/0297* (2013.01)

(58) Field of Classification Search
CPC .. G09G 3/2074; G09G 3/3225; G09G 3/3275; G09G 3/3283; G09G 3/3291;
(Continued)

(56) References Cited

U.S. PATENT DOCUMENTS

2011/0285950 A1* 11/2011 Su ..... G09G 3/3614 349/139
2014/0111406 A1* 4/2014 Wang ..... G09G 3/3233 345/77

(Continued)

FOREIGN PATENT DOCUMENTS

CN 105609066 A 5/2016
CN 105741735 A 7/2016

(Continued)

OTHER PUBLICATIONS

First Office Action for Chinese Application No. 201910086820.X, dated Jun. 3, 2021, 11 Pages.

*Primary Examiner* — Sahlu Okebato
(74) *Attorney, Agent, or Firm* — Brooks Kushman P.C.

(57) ABSTRACT

A display panel, a display device and a display control method thereof are provided in the present disclosure. The display panel includes: a time division multiplexing multiplexer (MUX) signal input circuit, which is connected with each of the plurality of signal lines, and configured to input data signals of each frame of display image to the plurality of signal lines, and for each frame of display image, input trigger signals corresponding to sub-pixel units of different colors to the plurality of signal lines in a time-sharing manner; among the plurality of signal lines, electrical signals on a plurality of adjacent first signal lines are arranged in sequence according to an order of positive, positive, negative and negative; among the plurality of signal lines, a (Continued)

first signal line has a spacing distance from adjacent signal lines less than a preset value.

16 Claims, 6 Drawing Sheets

(58) Field of Classification Search
CPC .. G09G 3/3685; G09G 3/3688; G09G 3/3692; G09G 3/3659; G09G 2300/0426; G09G 2300/0452; G09G 2310/0297
See application file for complete search history.

(56) References Cited

U.S. PATENT DOCUMENTS

| | | | | |
|---|---|---|---|---|
| 2015/0091859 | A1* | 4/2015 | Rosenberg | G06F 3/0447 345/174 |
| 2016/0189600 | A1 | 6/2016 | Shin et al. | |
| 2016/0225303 | A1* | 8/2016 | Kim | G09G 3/3648 |
| 2017/0287992 | A1* | 10/2017 | Kwak | H04M 1/0264 |
| 2018/0182324 | A1* | 6/2018 | Lin | G09G 3/3614 |

FOREIGN PATENT DOCUMENTS

| | | | |
|---|---|---|---|
| CN | 108732841 | A | 11/2018 |
| CN | 108831368 | A | 11/2018 |
| JP | 2002207459 | A | 7/2002 |

* cited by examiner

DISPLAY PANEL, DISPLAY DEVICE AND DISPLAY CONTROL METHOD THEREOF

CROSS-REFERENCE TO RELATED APPLICATION

This application claims priority to Chinese Patent Application No. 201910086820.X filed on Jan. 29, 2019, which is incorporated herein by reference in its entirety.

TECHNICAL FIELD

The present disclosure relates to the field of display technologies, in particular to a display panel, a display device and a display control method thereof.

BACKGROUND

With development of full screen display panel, narrow frame design has been studied with great efforts by manufacturers of panels and terminals. At present, components such as a camera, an earpiece and a sensor are disposed inside a display screen, thereby the display screen can be formed to have narrow frame, such approach provides one solution for realizing the narrow frame design of the display panel, and conforms to a market trend of a current display product.

SUMMARY

A display panel is provided in some embodiments of the present disclosure. The display panel includes a substrate, pixel units disposed on the substrate, and a plurality of signal lines, the display panel further includes: a time division multiplexing multiplexer (MUX) signal input circuit, which is connected with each of the plurality of signal lines, and configured to input data signals of each frame of display image to the plurality of signal lines, and for each frame of display image, input trigger signals corresponding to sub-pixel units of different colors to the plurality of signal lines in a time-sharing manner; wherein, in response to each of the trigger signals and each of the data signals, an electrical signal on each of the plurality of signal lines is positive or negative, and among the plurality of signal lines, electrical signals on a plurality of adjacent first signal lines are arranged in sequence according to an order of positive, positive, negative and negative; wherein among the plurality of signal lines, a first signal line has a spacing distance from adjacent signal lines less than a preset value.

In one example, the MUX signal input circuit is configured to input the data signals of a first type of frame of display image to the plurality of signal lines, and input the trigger signals corresponding to sub-pixel units of different colors to the plurality of signal lines in sequence according to a first color order; and the MUX signal input circuit is further configured to input the data signals of a second type of frame of display image to the plurality of signal lines, and input the trigger signals corresponding to sub-pixel units of different colors to the plurality of signal lines in sequence according to a second color order;

wherein, the second type of frame of display image is a frame of image adjacent to the first type of frame of display image, and the first color order is different from the second color order.

In one example, the MUX signal input circuit includes a plurality of signal output terminals arranged sequentially, and in response to each of the trigger signals and each of the data signals, voltages output by the plurality of signal output terminals arranged sequentially are positive or negative;

wherein a plurality of first signal lines are connected with the plurality of signal output terminals one by one, and by connecting each of the plurality of first signal lines with a corresponding signal output terminal, electrical signals on the plurality of adjacent first signal lines are arranged in sequence according to an order of positive, positive, negative and negative.

In one example, at least one portion of the plurality of first signal lines are in a curved shape.

In one example, the plurality of first signal lines in the curved shape are sequentially arranged around a periphery of a preset pattern area of the substrate, wherein the pixel units are disposed on an area outside the preset pattern area on the substrate.

In one example, each of the plurality of first signal lines in the curved shape includes a first line portion in an arc shape and a second line portion in a straight line connected with the first line portion.

In one example, a quantity of the plurality of first signal lines is an integral multiple of 12.

In one example, for every 12 adjacent first signal lines 210 among the plurality of first signal lines, corresponding colors of the sub-pixel units connected with the 12 adjacent first signal lines are arranged in an order of a first color, a second color, a third color, the first color, the third color, the first color, the second color, the third color, the second color, the third color, the first color, and the second color.

In one example, the first color is red, the second color is blue and the third color is green.

In one example, the first line portions of two adjacent first signal lines are parallel to each other, and the second line portions of two adjacent first signal lines are parallel to each other, and a vertical distance between the two adjacent first line portions is smaller than a vertical distance between the two adjacent second line portions.

In one example, the MUX signal input circuit includes:

a plurality of switch transistors, wherein a first electrode of each of the plurality of switch transistors forms a signal output terminal of the MUX signal input circuit, and a second electrode of each of the plurality of switch transistors is connected with a data line; and a plurality of MUX signal lines, wherein each of the plurality of MUX signal lines corresponds to a sub-pixel unit of one color, and is connected with a control terminal of one of the plurality of switch transistors; wherein a trigger signal is input through a MUX signal line, a switch transistor connected with the MUX signal line is turned on to form a conductive connection between the first electrode and the second electrode of the switch transistor, the data signal input through the data line is transmitted to the signal output terminal of the MUX signal input circuit, so that the electrical signal on the signal line connected with the signal output terminal of the MUX signal input circuit is positive or negative.

In one example, the data lines includes a first data line and a second data line, the second electrodes of one portion of the switch transistors are connected with the first data line, and the second electrodes of the other portion of the switch transistors are connected with the second data line;

wherein, when the data signals of each frame of display image are input through the data lines, one of the first data line and the second data line is positive, and the other of the first data line and the second data line is negative.

In one example, the signal lines include a plurality of second signal lines, in response to each of the trigger signals and each of the data signals, electrical signals on the plurality of adjacent second signal lines are arranged in sequence according to an order of positive, negative, positive and negative.

In one example, the substrate is further provided with a plurality of third signal lines;

wherein an input terminal of each of the plurality of first signal lines is connected with the MUX signal input circuit, and output terminals of the plurality of first signal lines are connected with the plurality of third signal lines one by one; and by connecting the output terminal of each of the plurality of first signal lines with a corresponding third signal line, electrical signals on the plurality of adjacent third signal lines are arranged in sequence according to an order of positive, negative, positive and negative.

Some embodiments of the present disclosure further provide a display device including any one of the above display panels.

Some embodiments of the present disclosure further provide a display control method for a display device, applied to the above display device, the method includes:

inputting the data signals of a first type of frame of display image to the MUX signal input circuit, and inputting the trigger signals corresponding to sub-pixel units of different colors in sequence to the MUX signal input circuit according to a first color order;

inputting the data signals of a second type of frame of display image to the MUX signal input circuit, and inputting the trigger signals corresponding to sub-pixel units of different colors in sequence to the MUX signal input circuit according to a second color order;

wherein, the second type of frame of display image is a frame of image adjacent to the first type of frame of display image, and the first color order is different from the second color order.

In one example, the first color order is red, blue, and green, and the second color order is green, blue, and red.

DETAILED DESCRIPTION

In order to illustrate the technical problems, the technical solutions and merits of the present disclosure in a clearer manner, the drawings desired for the present disclosure will be described hereinafter briefly.

Figure 1:
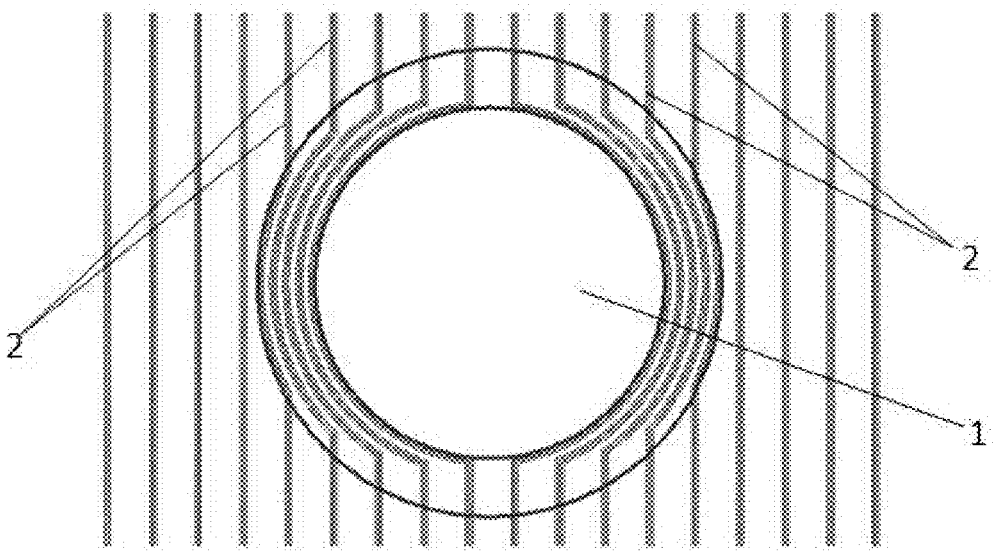
FIG. 1 is a schematic diagram illustrating one of arrangement structures of data lines on a display panel in the related art.

When components such as camera, earpiece, and sensor are disposed inside a display screen, in order to solve a transmittance problem during operation of the component, a part of the display screen corresponding to the component is generally designed to be transparently displayed in the related art, as shown in FIG. 1, when the above setting mode is adopted, a light-transmitting area 1 is formed on a display panel corresponding to a position of the component, and data lines 2 driving pixel units of the display panel are around the light-transmitting area 1, and are arranged around the light-transmitting area 1 in an arc shape. Since a distance between the adjacent data lines in the arc shape is smaller than a distance between the data lines (data lines parallel to each other) of the pixel units located in a normal area, coupling capacitance of the data lines in the arc shape is larger than that of the data lines parallel to each other.

Figure 2:
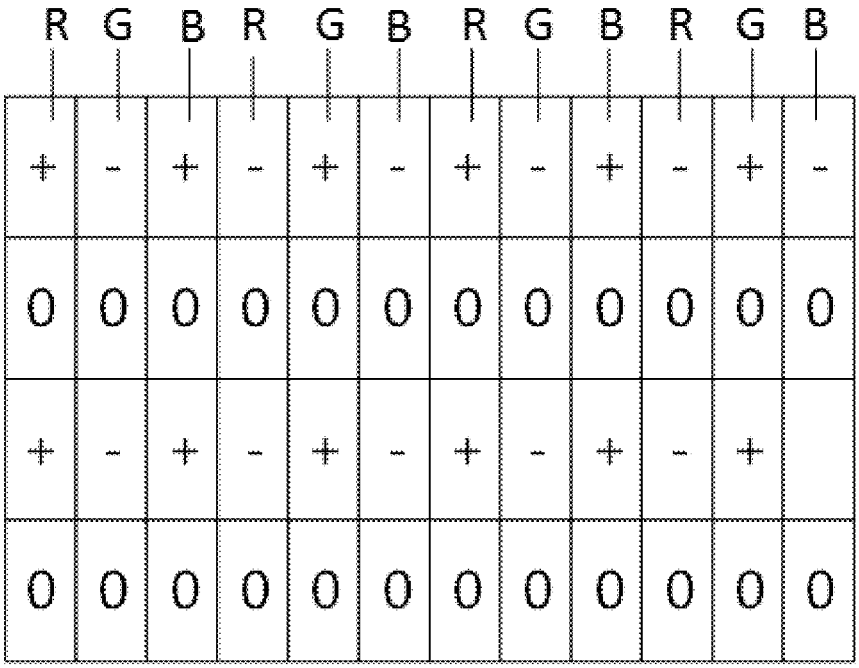
FIG. 2 is a schematic diagram illustrating a display state when performing a H1Line screen detection on a display panel.
Figure 3:
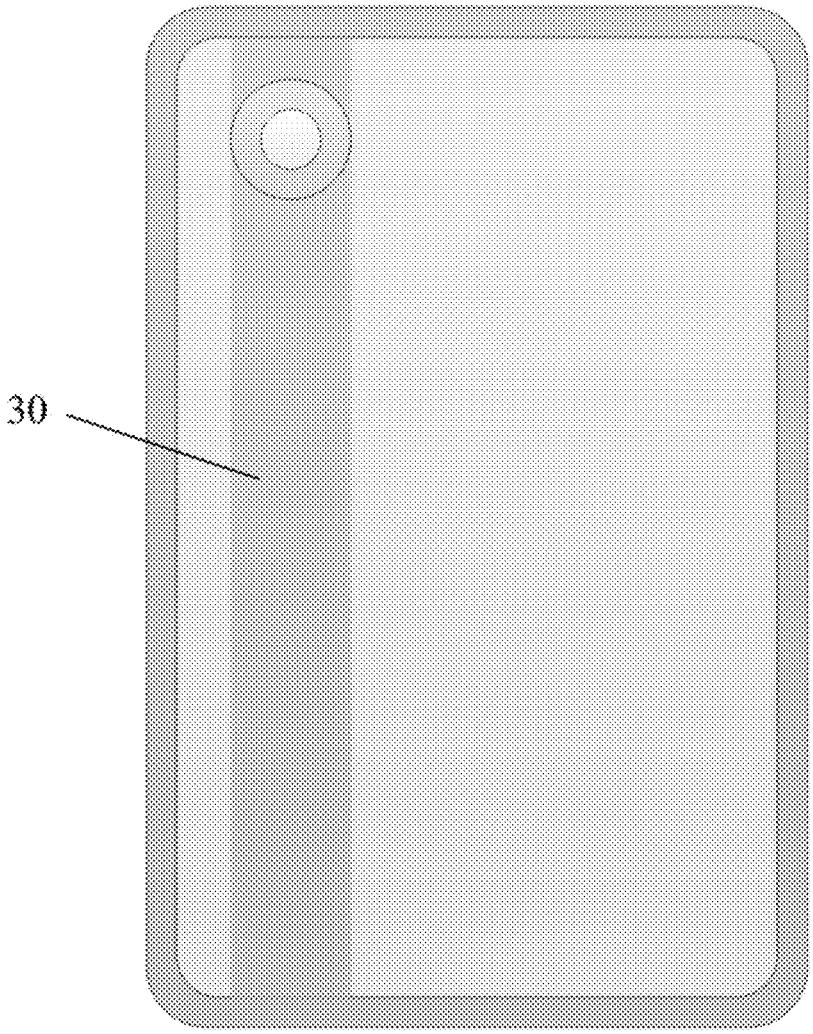
FIG. 3 is a schematic diagram illustrating a vertical Mura on a display panel in the related art.

Further, as shown in FIG. 2, an H1Line screen detection in the display panel is needed to be performed, and in the H1Line screen, one row of pixels in each two adjacent rows of pixels is bright and the other row of pixels in each two adjacent rows of pixels is dark. When performing the H1Line screen detection, one row of pixels in the pixel units in the display panel is bright and an adjacent row of pixels in the pixel units in the display panel is dark. As shown in FIG. 1, since the coupling capacitance of the data lines in the arc shape is larger than that of the data lines parallel to each other, when display, for each frame of image, red (R), green (G), and blue (B) data are sequentially input, and when signals are turned on, due to mutual influences of the coupling capacitance between corresponding R, G and B data lines, brightness of the pixel units above and below the light-transmitting area 1 is smaller than that of the pixel units in other areas, resulting in a vertical Mura, as shown by 30 in FIG. 3, so that the display panel cannot meet detection requirements.

In order to solve a problem that in the display panel of the related art, when a spacing distance between a plurality of data lines to be arranged is relatively small, the coupling capacitance between the plurality of data lines is large, and when the H1Line screen detection is performed, the vertical Mura appears, some embodiments of the present disclosure provide a display panel, an order of positive, negative, positive and negative according to which electrical signals on a plurality of signal lines are sequentially arranged is replaced with an order of positive, positive, negative and negative, in combination with an input order of trigger signals, the coupling capacitance of the signal lines may be offset to each other, thereby solving the problem that when the spacing distance between the data lines is small, the coupling capacitance is large.

Figure 4:
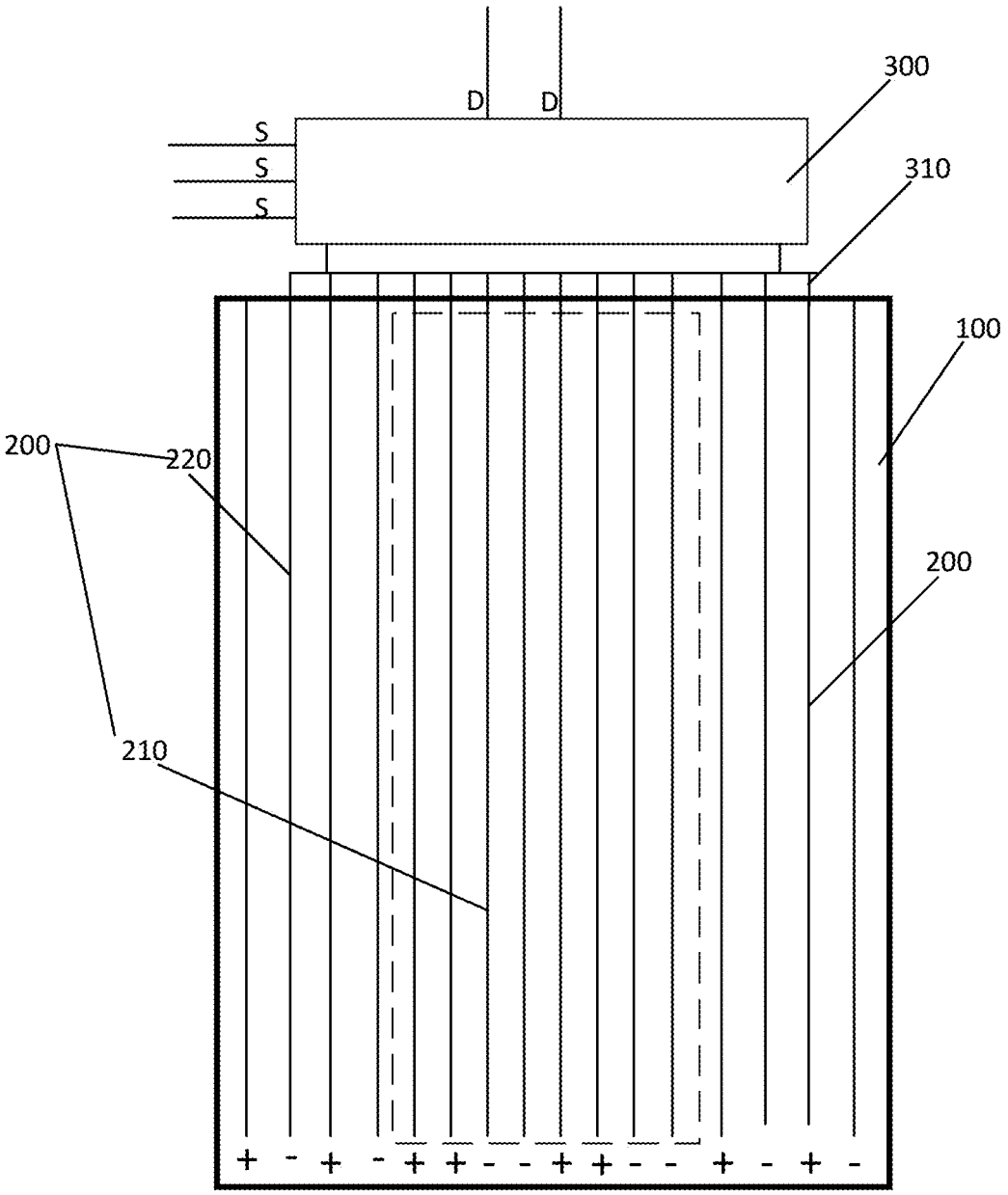
FIG. 4 is a schematic diagram illustrating a structure of a display panel according to some embodiments of the present disclosure.

Specifically, the display panel in some embodiments of the present disclosure, as shown in FIG. 4, includes a substrate 100, pixel units (not shown) disposed on the substrate 100, and a plurality of signal lines 200, the display panel further includes:

a time division multiplexing multiplexer (MUX) signal input circuit 300, connected with each of the plurality of signal lines 200, configured to input data signals D of each frame of display image to the plurality of signal lines 200, and input trigger signals S corresponding to sub-pixel units of different colors to the plurality of signal lines corresponding to each frame of display image in time sharing; wherein, in response to each of the trigger signals S and each of the data signals D, an electrical signal on each of the plurality of signal lines 200 is positive or negative, and among the plurality of signal lines 200, electrical signals on a plurality of adjacent first signal lines 210 are sequentially arranged according to an order of positive +, positive +, negative − and negative −.

It should be appreciated that, in the display panel, a space between the plurality of signal lines 200 and a plurality of grid lines set crosswise on the substrate 100 forms as an arrangement space of the pixel units. A person skilled in the art shall be able to understand connection modes between the pixel units, the signal lines 200 and the grid lines in the display panel, which will not be described in detail herein.

In some embodiments of the present disclosure, it should be appreciated that, the plurality of signal lines 200 arranged on the substrate 100 are separated from each other, and each signal line 200 is connected with one of the sub-pixel units respectively.

In the display panel according to some embodiments of the present disclosure, among the plurality of signal lines 200 arranged on the substrate 100, electrical signals on the plurality of adjacent signal lines 200 are arranged sequentially according to the order of positive +, positive +, negative − and negative −, and the plurality of signal lines 200 arranged sequentially according to the order of positive +, positive +, negative − and negative − are referred to as the first signal lines 210.

Optionally, the MUX signal input circuit is configured to input the data signals of a first type of frame of display image to the plurality of signal lines, and input sequentially the trigger signals corresponding to sub-pixel units of different colors to the plurality of signal lines according to a first color order; and the MUX signal input circuit is further configured to input the data signals of a second type of frame of display image to the plurality of signal lines, and input sequentially the trigger signals corresponding to sub-pixel units of different colors to the plurality of signal lines according to a second color order;

the second type of frame of display image is a frame of image adjacent to the first type of frame of display image, and the first color order is different from the second color order.

The data signals of the first type of frame of display image may be data signals of an odd frame of display image, the data signals of the second type of frame of display image may be data signals of an even frame of display image, of course, they may also be interchanged, i.e., the data signals of the first type of frame of display image is the data signals of an even frame of display image, the data signals of the second type of frame of display image is the data signals of an odd frame of display image.

For example, when a pixel unit includes R, G, and B sub-pixel units, the first color order may be MUXR→MUXB→MUXG, and the second color order may be MUXG→MUXB→MUXR.

Optionally, the plurality of signal lines 200 on the substrate 100 may include a plurality of second signal lines 220 connected with the MUX signal input circuit 300. In response to each of the trigger signals S and each of the data signals D, electrical signals on the plurality of adjacent second signal lines 220 are sequentially arranged according to an order of positive +, negative −, positive + and negative −.

Specifically, in response to each of the trigger signals S and each of the data signals D, each of the plurality of signal lines 200 is positive or negative, i.e., an output terminal of the MUX signal input circuit 300 connected with each of the plurality of signal lines 200 is positive or negative. Based on this, when the plurality of signal lines 200 are formed on the substrate 100, each of the plurality of signal lines 200 is connected with the corresponding output terminal of the MUX signal input circuit 300, the electrical signals on the plurality of adjacent first signal lines are sequentially arranged according to the order of positive +, positive +, negative − and negative −, and the electrical signals on the plurality of adjacent second signal lines 220 are sequentially arranged according to the order of positive +, negative −, positive + and negative −.

In some embodiments of the present disclosure, optionally, all of the signal lines 200 may form the first signal lines 210, i.e., the signal lines 200 connected with the MUX signal input circuit 300, in response to the trigger signals S and the data signals D input by the MUX signal input circuit 300, the electrical signals on the plurality of adjacent signal lines 200 are arranged sequentially according to the order of positive +, positive +, negative −, and negative −.

Optionally, only a portion of the signal lines 200 may form the first signal lines 210, and the other portion of the signal lines 200 may form the second signal lines 220. Optionally, among the plurality of signal lines 200, a first signal line 210 has a spacing distance from adjacent signal lines 200 less than a preset value. The preset value may be determined according to a critical distance between two adjacent signal lines where the vertical Mura appears when perform the H1Line screen detection.

In some embodiments of the present disclosure, a quantity of the plurality of first signal lines 210 is an integral multiple of 12, the electrical signals on each 12 adjacent first signal lines are arranged according to an order of positive +, positive +, negative −, negative −, positive +, positive +, negative −, negative −, positive +, positive +, negative − and negative −.

Figure 5:
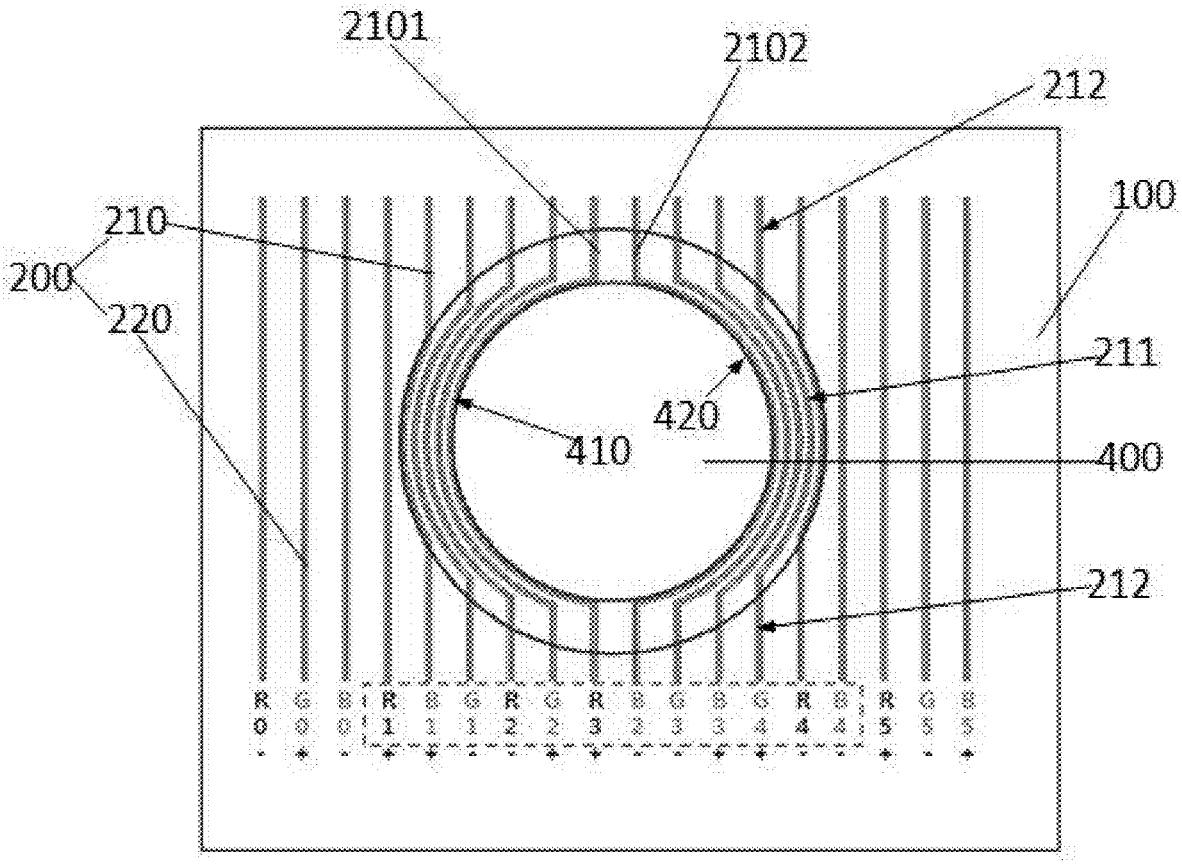
FIG. 5 is a schematic diagram illustrating one of arrangement structures of data lines by using the display panel according to some embodiments of the present disclosure.

FIG. 5 is a schematic diagram illustrating one of arrangement structures of data lines by using the display panel according to some embodiments of the present disclosure. In the display panel of some embodiments of the present disclosure, among the plurality of first signal lines 210, at least a portion of the plurality of first signal lines 210 are in a curved shape. And the plurality of first signal lines 210 in the curved shape are sequentially arranged around a periphery of a preset pattern area 400 of the substrate, wherein the pixel units are disposed on an area outside the preset pattern area 400 on the substrate 100.

In the display panel, the preset pattern area 400 may be formed as a light-transmitting area for disposing the camera, earpiece, sensor and other component. Specifically, in a display device in which the display panel is installed, the component such as the camera, the earpiece and the sensor may be installed in the interior of the display device, and installed in a corresponding position of the preset pattern area 400 on the substrate 100, i.e., an orthographic projection of a sensing interface of the component, such as the camera, the earpiece and the sensor, on the substrate 100 is located within the preset pattern area 400.

In some embodiments of the present disclosure, the signal lines 200 are arranged around the periphery of the preset pattern area 400 to ensure a transmittance of the preset pattern area 400. The plurality of signal lines 200 distributed around the periphery of the preset pattern area 400 forms the first signal lines 210.

Specifically, as shown in FIG. 5, among the plurality of first signal lines 210, at least a portion of first target signal lines 2101 are arranged around a first edge 410 of the preset pattern area 400, at least a portion of second target signal lines 2102 are arranged around a second edge 420 of the preset pattern area 400, the first edge 410 and the second edge 420 are opposed to each other.

A portion of the plurality of first signal lines 210 are sequentially arranged at one side of the first target signal lines 2101 away from the second target signal lines 2102, a portion of the plurality of first signal lines 210 are sequentially arranged at one side of the second target signal lines 2102 away from the first target signal lines 2101.

With the above arrangement, at least a portion of the plurality of first signal lines 210 is formed as a structure surrounding the periphery of the preset pattern area 400.

Optionally, in some embodiments of the present disclosure, as shown in FIG. 5, the preset pattern area 400 is circular. It should be appreciated that, the preset pattern area 400 is not limited to being formed only in a circular shape, and may also be formed in a rectangular shape or other irregular shapes, a specific shape and a scope may be determined according to a shape and a size of the component such as the camera, the earpiece, and the sensor.

When the preset pattern area 400 is circular, the first signal line 210 in the curved shape includes a first line portion 211 in an arc shape and a second line portion 212 as a straight line. Optionally, each end of the first line portion 211 is provided with the second line portion 212 having the shape of straight line.

In some embodiments of the present disclosure, first line portions 211 of a portion of the first signal lines 210 are parallel to each other, and are arranged around the first edge 410 of the preset pattern area 400, the first line portions 211 of the portion of the first signal lines 210 are parallel to each other, and are arranged around the second edge 420 of the preset pattern area 400. In addition, second line portions 212 of the first signal lines 210 are parallel to each other, and spacing distances between each two adjacent second line portions 212 are equal. Since the first line portions 211 of the plurality of first signal lines 210 parallel to each other are in the arc shape, a vertical distance between two adjacent first line portions 211 is smaller than a vertical distance between two adjacent second line portions 212.

The above arrangement mode of the first signal lines on the substrate is merely one example, the present disclosure is not limited thereto.

Figure 6:
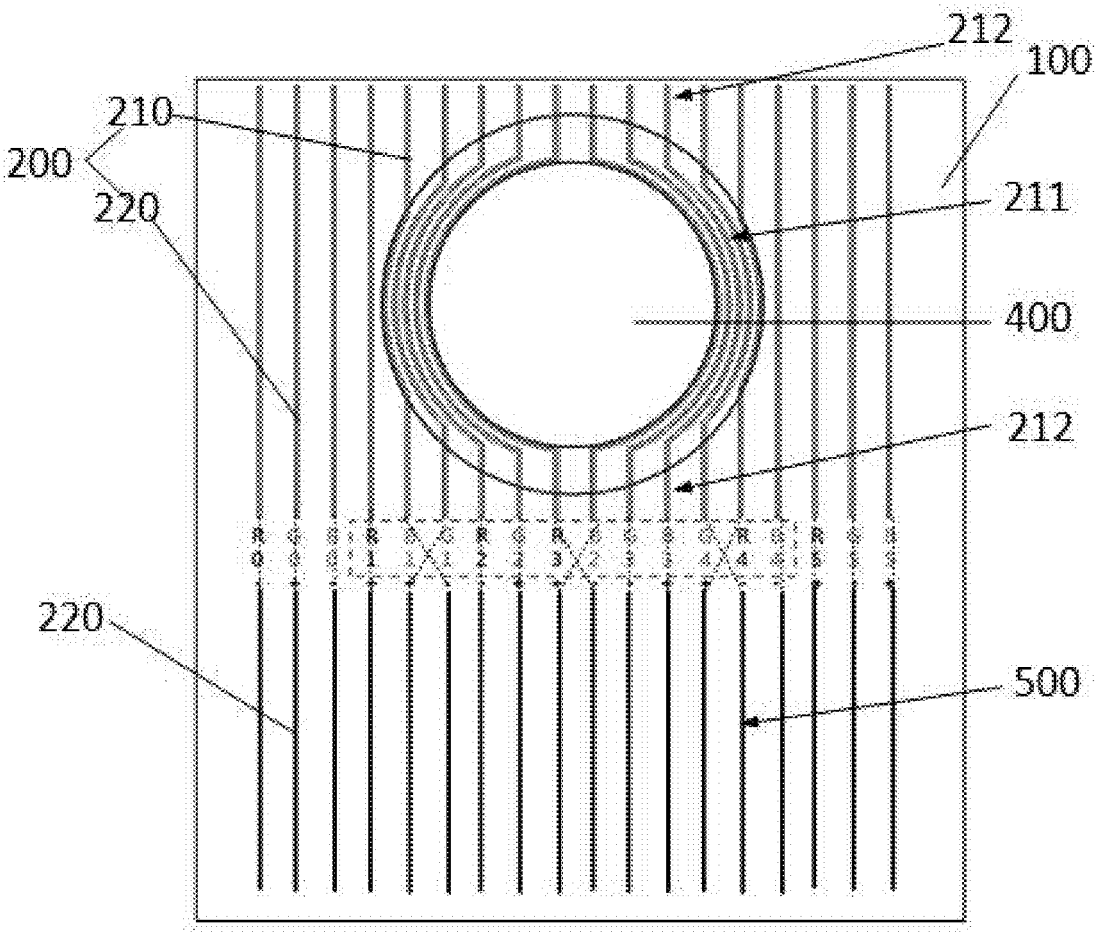
FIG. 6 is a schematic diagram illustrating another one of arrangement structures of data lines by using the display panel according to some embodiments of the present disclosure.

In the display panel according to some embodiments of the present disclosure, as shown in FIG. 6, the substrate 100 of the display panel is further provided with a plurality of third signal lines 500, the third signal lines 500 are connected with the first signal lines 210 one by one. As shown in FIG. 4, the MUX signal input circuit 300 inputs the trigger signals S and the data signals D, when the electrical signals on the plurality of adjacent first signal lines 210 are sequentially arranged according to the order of positive +, positive +, negative − and negative −, the electrical signals on the plurality of adjacent third signal lines 500 are sequentially arranged according to the order of positive +, negative −, positive + and negative −.

Specifically, as shown in FIG. 4, an input terminal of each of the plurality of first signal lines 210 is connected with the MUX signal input circuit 300, and output terminals of the plurality of first signal lines 210 are connected with the plurality of third signal lines 500 one by one. By connecting each of the plurality of first signal lines 210 with a corresponding signal output terminal, the electrical signals on the plurality of adjacent third signal lines 500 are arranged in sequence according to an order of positive +, negative −, positive + and negative −.

In some embodiments of the present disclosure, as shown in FIG. 5 and FIG. 6, when the second line portion 212 is arranged at one end of the first line portion 211 of each first signal line 210, the second line portions 212 of the plurality of first signal lines 210 are parallel to each other, on the substrate 100, the plurality of third signal lines 500 are arranged at one side of the first signal lines 210, and each of the plurality of third signal lines 500 and the second line portion 212 of one of the first signal lines 210 are located on a same straight line, which forms a structure in which the plurality of third signal lines 500 are in one-to-one correspondence with the second line portions 212 of the plurality of first signal lines 210, i.e., an extension line of the second line portion 212 of each of the plurality of first signal lines 210 coincides with one of the third signal lines 500. With the above arrangement, when the electrical signals on the plurality of adjacent first signal lines 210 are sequentially arranged according to the order of positive +, positive +, negative − and negative −, the plurality of third signal lines 500 parallel to each other are respectively connected with the corresponding first signal lines 210, so that the electrical signals on the plurality of adjacent third signal lines 500 may be sequentially arranged according to the order of positive +, negative −, positive + and negative −.

In some embodiments of the present disclosure, as shown in FIG. 4, the MUX signal input circuit 300 further includes a plurality of signal output terminals 310 arranged sequentially, and in response to each of the trigger signals S and each of the data signals D, voltages output by the plurality of signal output terminals 310 arranged sequentially are positive or negative;

the plurality of first signal lines 210 are connected with the plurality of signal output terminals 310 one by one, and by connecting each of the plurality of first signal lines 210 with a corresponding signal output terminal 310, the electrical signals on the plurality of adjacent first signal lines 210 are arranged in sequence according to an order of positive, positive, negative and negative.

Figure 7:
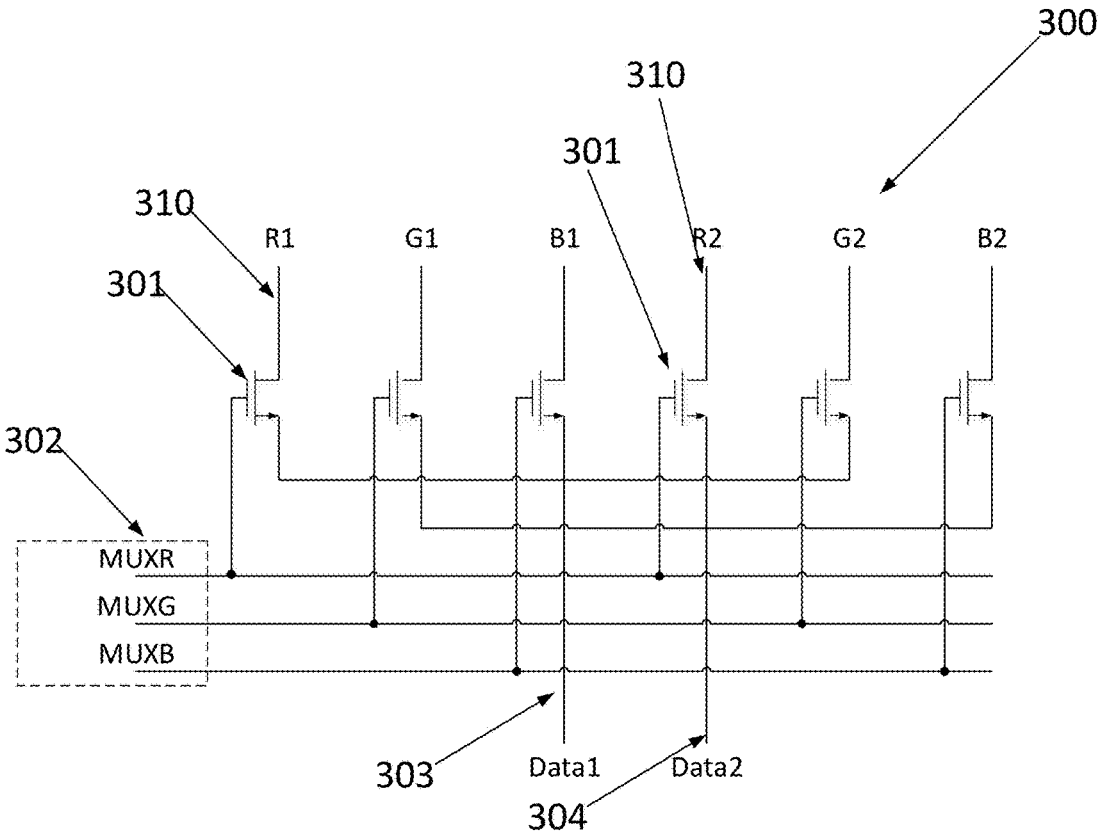
FIG. 7 is a schematic diagram illustrating a structure of a MUX signal input circuit according to some embodiments of the present disclosure.

FIG. 7 is a schematic diagram illustrating a structure of the MUX signal input circuit 300 in the display panel according to some embodiments of the present disclosure. In some embodiments of the present disclosure, the MUX signal input circuit 300 includes:

a plurality of switch transistors 301, wherein first electrodes of the plurality of switch transistors 301 form the plurality of signal output terminals 310 of the MUX signal input circuit 300, and second electrodes of the plurality of switch transistors 301 are connected with data lines; and a plurality of MUX signal lines 302, wherein each of the plurality of MUX signal lines 302 corresponds to one color of sub-pixel unit.

Optionally, the plurality of MUX signal lines 302 include MUXR, MUXG, and MUXB signal lines respectively, and is used for respectively inputting the trigger signals corresponding to R, G, and B sub-pixel units.

In addition, a control terminal of each of the plurality of switch transistors 301 is connected with one of the plurality of MUX signal lines 302; wherein a trigger signal is input through a MUX signal line 302, a switch transistor 301 connected with the MUX signal line 302 is turned on to form a conductive connection between the first electrode and the second electrode of the switch transistor, the data signal input through the data line is transmitted to the signal output terminal 310 of the MUX signal input circuit 300, so that the electrical signal on the signal line connected with the signal output terminal of the MUX signal input circuit 300 is positive or negative.

In some embodiments of the present disclosure, specifically, as shown in FIG. 7, the data lines includes a first data line 303 (Data 1) and a second data line 304 (Data 2), the second electrodes of one portion of the switch transistors 301 are connected with the first data line 303, and the second electrodes of the other portion of the switch transistors 301 are connected with the second data line 304;

wherein, when the data signals of each frame of display image are input through the data lines, one of the first data line 303 and the second data line 304 is positive, and the other is negative.

As shown in FIG. 7, taking an signal input of two pixel units as an example, six signal output terminals 310 of the MUX signal input circuit 300 are respectively used for outputting the data signals to each of the two pixel units, the signal output terminals 310 corresponding to a R1 sub-pixel unit, a G1 sub-pixel unit, a B1 sub-pixel unit, a R2 sub-pixel unit, a G2 sub-pixel unit, and a B2 sub-pixel unit are sequentially arranged, the second electrodes of the switch transistors 310 connected with the signal output terminals 310 corresponding to the R1 sub-pixel unit, the B1 sub-pixel unit and the G2 sub-pixel unit are connected with the first data line 303, the second electrodes of the switch transistors 310 connected with the signal output terminals 310 corresponding to the G1 sub-pixel unit, the R2 sub-pixel unit and the B2 sub-pixel unit are connected with the second data line 304.

Since polarities of the signals input through the first data line 303 and the second data line 304 are opposite, one of them is positive, and the other is negative, the electrical signals of the signal output terminals 310 corresponding to the R1 sub-pixel unit, the G1 sub-pixel unit, the B1 sub-pixel unit, the R2 sub-pixel unit, the G2 sub-pixel unit, and the B2 sub-pixel unit respectively are sequentially arranged according to the order of positive +, negative −, positive + and negative −.

Based on the above arrangement of the electrical signals of the plurality of signal output terminals 310, as shown in FIG. 5, when the signal lines on the substrate 100 include the plurality of second signal lines 220, the electrical signals on the plurality of adjacent second signal lines 220 are required to be sequentially arranged according to the order of positive, negative, positive and negative, the plurality of second signal lines 220 may be sequentially connected with the plurality of signal output terminals 310 of the MUX signal input circuit 300 in a one-to-one correspondence, the electrical signals on the plurality of adjacent second signal lines 220 may be sequentially arranged according to the order of positive, negative, positive and negative.

For the plurality of first signal lines 210 on the substrate 100, as shown in FIG. 5, the signal output terminals 310 corresponding to the first signal lines 210 are respectively selected, so that the electrical signals on the plurality of adjacent first signal lines are sequentially arranged according to the order of positive, positive, negative and negative.

For example, as shown in FIG. 5, the quantity of the first signal lines 210 is 12, with reference to FIG. 7, the signal output terminals corresponds to the R1 sub-pixel unit, the G1 sub-pixel unit, the B1 sub-pixel unit, the R2 sub-pixel unit, the G2 sub-unit, the B2 sub-pixel unit, a R3 sub-pixel unit, a G3 sub-pixel unit, a B3 sub-pixel unit, a R4 sub-pixel unit, a G4 sub-pixel unit, and a B4 sub-pixel unit are sequentially arranged, i.e., the signal output terminals of the R1 sub-pixel unit, the G1 sub-pixel unit, the B1 sub-pixel unit, the R2 sub-pixel unit, the G2 sub-unit, the B2 sub-pixel unit, the R3 sub-pixel unit, the G3 sub-pixel unit, the B3 sub-pixel unit, the R4 sub-pixel unit, the G4 sub-pixel unit, and the B4 sub-pixel unit are respectively connected with the first signal lines 210 arranged sequentially, the electrical signals are sequentially arranged according to the order of positive, negative, positive and negative.

Referring to FIG. 6, in some embodiments of the present disclosure, as compared with that shown in FIG. 5, connection orders of the signal output terminal of the B1 sub-pixel unit and the signal output terminal of the G1 sub-pixel unit connected with the corresponding first signal line 210, the signal output terminal of the B2 sub-pixel unit and the signal output terminal of the R3 sub-pixel connected with the corresponding first signal line 210, the signal output terminal of the R4 sub-pixel unit and the signal output terminal of the G4 sub-pixel unit connected with the corresponding first signal line 210, are respectively interchanged. That is, the first signal lines 210 arranged sequentially are connected with the signal output terminals corresponds to the R1 sub-pixel unit, the B1 sub-pixel unit, the G1 sub-pixel unit, the R2 sub-pixel unit, the G2 sub-unit, the R3 sub-pixel unit, the B2 sub-pixel unit, the G3 sub-pixel unit, the B3 sub-pixel unit, the G4 sub-pixel unit, the R4 sub-pixel unit, and the B4 sub-pixel unit sequentially, thus the electrical signals on the plurality of adjacent first signal lines 210 are sequentially arranged according to the order of positive, positive, negative and negative.

According to FIG. 4 to FIG. 6, optionally, two ends of the first line portion 211 of each first signal line 210 are respectively connected with one of the second line portions 212 for respectively being connected with the signal output terminal 310 of the MUX signal input circuit 300 and the third signal line 500.

For the third signal lines 500, according to FIG. 4 to FIG. 6, when the plurality of adjacent third signal lines 500 are respectively connected with the first signal lines 210 sequentially connected with the signal output terminals of the R1 sub-pixel unit, the G1 sub-pixel unit, the B1 sub-pixel unit, and the R2 sub-pixel unit, the G2 sub-pixel unit, the B2 sub-pixel unit, the R3 sub-pixel unit, the G3 sub-pixel unit, the B3 sub-pixel unit, the R4 sub-pixel unit, the G4 sub-pixel unit, and the B4 sub-pixel unit, the electrical signals on the plurality of adjacent third signal lines 500 are sequentially arranged according to the order of positive, negative, positive and negative.

In the display panel of the related art, the electrical signals on the plurality of adjacent signal lines may only be arranged according to the order of positive, negative, positive and negative, when the spacing distance between the signal lines is small, during a display of one frame of image, when the trigger signals for each color of sub-pixel unit are sequentially input, the signal line corresponding to the signal output terminal of a R sub-pixel unit (which may be referred to as an R signal line), and adjacent signal lines are the signal line corresponding to the signal output terminal of a G sub-pixel unit (which may be referred to as a G signal line) and the signal line corresponding to the signal output terminal of a B sub-pixel unit (which may be referred to as a B signal line). A voltage jump direction of the G signal line and the B signal line are opposite to a voltage jump direction of the R signal line, which causes the R signal line to be coupled, and a voltage difference between the R signal line and a common electrode voltage VCOM is reduced. Since a gate line Gate is in an open state at this time, the brightness of the R sub-pixel unit is lowered. Similarly, the voltage jump direction of the B signal line adjacent to the G signal line is opposite to that of the G signal line, so that the G signal line is coupled, a voltage difference between the B signal line and the VCOM is reduced, and the brightness of the G sub-pixel unit is lowered. Thus, when the spacing distance is small, for example, the spacing distance between the first line portions of the first signal lines 210 surrounding the preset pattern area 400 as shown in FIG. 5 is small compared with the pixel units in the normal area, the brightness is low and vertical Mura appears.

By using the display panel according to the embodiments of the present disclosure, compared with the related art, the order of positive, negative, positive, and negative according to which the electrical signals on the plurality of signal lines are sequentially arranged is replaced with the order of positive, positive, negative and negative, the coupling capacitance of the signal lines may be offset to each other, thereby solving the problem that during the display of one frame of image, when the trigger signals for each color of sub-pixel unit are sequentially input, the voltage jump direction of one of the signal lines is opposite to that of an adjacent signal line, the coupling capacitance between the adjacent signal lines is large, the brightness of the corresponding sub-pixel unit is lowered, and the vertical Mura appears.

In the display panel according to some embodiments of the present disclosure, optionally, when a pixel unit includes three sub-pixel units, a quantity of the plurality of first signal lines is an integer multiple of 12, and each 12 first signal lines correspond to 12 sub-pixel units, i.e., 4 pixel units. Specifically, according to FIG. 5, when a quantity of pixel units corresponding to the plurality of first signal lines 210 is an integer multiple of 4, the first signal lines 210 can be arranged according to FIG. 5, so that for one of the signal lines, the voltage jump directions of two adjacent signal lines are opposite and offset to each other, thereby reducing coupling capacitance of the adjacent signal lines.

Specifically, referring to FIG. 5, for every 12 adjacent first signal lines 210 among the plurality of first signal lines, corresponding colors of the sub-pixel units connected with the 12 adjacent first signal lines are arranged in an order of a first color, a second color, a third color, the first color, the third color, the first color, the second color, the third color, the second color, the third color, the first color and the second color. In some embodiments of the present disclosure, optionally, the first color is red, the second color is blue and the third color is green.

In addition, when the second signal lines 220 are further arranged on the substrate 100 in the display panel, corresponding colors of the sub-pixel units connected with the plurality of adjacent second signal lines 220 are sequentially arranged according to an order of the first color, the third color and the second color. Specifically, according to FIG. 5, when the plurality of second signal lines 220 are arranged at both sides of the plurality of first signal lines 210, the corresponding colors of the sub-pixel units connected with the plurality of second signal lines 220 located at both sides of the plurality of first signal lines 210 are sequentially arranged according to an order of red, green, and blue.

In addition, in some embodiments of the present disclosure, as shown in FIG. 5, for the plurality of signal lines 200 arranged around the preset pattern area 400, the integer multiple of 12 signal lines may be selected as the first signal lines 210, when the quantity of the signal lines 200 in the curved shape is not the integral multiple of 12, the signal lines 200 in the straight line at both sides of the signal lines 200 in the curved shape may be selected as the first signal lines 210 to realize that the quantity of the signal lines 200 in the curved shape is the integral multiple of 12. Thus, the first signal lines 210 may include the signal lines 200 in the curved shape, and further include the signal lines 200 in the straight line. Or, the signal lines 200 in the curved shape of the integer multiple of 12 in the middle may be selected as the first signal lines 210, the signal lines 200 in the curved shape at edges are arranged in a normal way, i.e., as the second signal lines 220. For example, when the quantity of the plurality of signal lines 200 arranged around the preset pattern area 400 is 62, sixty signal lines 200 in the middle may be selected as the first signal lines 210, and two signal lines 200 at the edges are used as the second signal lines.

Some embodiments of the present disclosure, in another aspect, further provide a display device including the display panel described above.

With reference to FIG. 4 to FIG. 7, a person skilled in the art should be able to understand the specific structure of the display device using the display panel according to some embodiments of the present disclosure, which will not be described in detail herein.

Some embodiments of the present disclosure further provide a display control method for a display device, according to the above display panel, the coupling capacitance of the signal lines is offset to each other in combination with the input order of the trigger signals, thereby solving the problem that when the spacing distance between the data lines is small, the coupling capacitance is large, the vertical Mura is caused.

Specifically, by using the display panel with the above structure according to some embodiments of the present disclosure, when performing the H1Line screen detection or performing a display data input to enable the display panel to display an image, the following display control method may be adopted:

inputting the data signals of a first type of frame of display image to the MUX signal input circuit, and inputting sequentially the trigger signals corresponding to sub-pixel units of different colors to the MUX signal input circuit according to a first color order;

inputting the data signals of a second type of frame of display image to the MUX signal input circuit, and inputting sequentially the trigger signals corresponding to sub-pixel units of different colors to the MUX signal input circuit according to a second color order;

wherein, the second type of frame of display image is a frame of image adjacent to the first type of frame of display image, and the first color order is different from the second color order.

Figure 8:
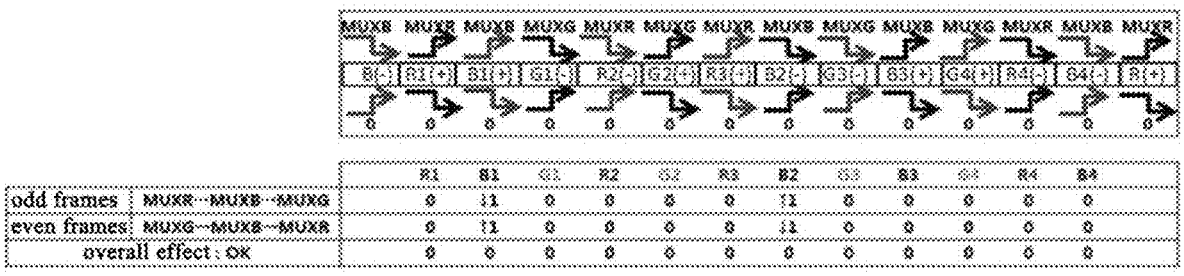
FIG. 8 is a schematic diagram of a signal jump state on data lines by using the display panel according to some embodiments of the present disclosure.

According to FIG. 8, a voltage state on each sub-pixel unit may represent a state of the electrical signal on the connected signal line. In some embodiments of the present disclosure, when the electrical signals on the plurality of adjacent first signal lines are sequentially arranged according to the order of positive, positive, negative and negative, the voltages on the connected sub-pixel units are also sequentially arranged according to the order of positive, positive, negative and negative.

It should be appreciated that, in response to the input data signal of each frame of display image, the electrical signals on the plurality of first signal lines are sequentially arranged according to the order of positive, positive, negative and negative. The order of positive, positive, negative and negative is only for explaining the arrangement of the electrical signals on the plurality of first signal lines, and is not limit to that, from a first one of the first signal lines at one edge to a last one of the first signal lines at the other opposite edge, the order of the electrical signals must start from positive, and must be positive, positive, negative and negative.

According to FIG. 8, it should be appreciated that, for the data signals of the first type of frame of display image, from the first one of the first signal lines at one edge to the last one of the first signal lines at the other opposite edge, the order of the electrical signals starts from positive, and is positive, positive, negative and negative. For the data signals of the adjacent second type of frame of display image, from the first one of the first signal lines at one edge to the last one of the first signal lines at the other opposite edge, the order of the electrical signals starts from negative, and is negative, negative, positive, positive, negative and negative.

In the display control method according to some embodiments of the present disclosure, the data signals of the first type of frame of display image may be the data signals of the odd frame of display image, the data signals of the second type of frame of display image may be the data signals of the even frame of display image, of course, they may also be interchanged, i.e., the data signals of the first type of frame of display image is the data signals of the even frame of display image, the data signals of the second type of frame of display image is the data signals of the odd frame of display image. Taking FIG. 5 as an example, and in conjunction with FIG. 7 and FIG. 8, for example, by using the display control method in some embodiments of the present disclosure, the data signals of the first type of frame of display image are input to the MUX signal input circuit, i.e., the data signals of the odd frame of display image are input, and the trigger signals corresponding to sub-pixel units of different colors are input sequentially to the MUX signal input circuit according to the first color order, the first color order may be MUXR→MUXB→MUXG. When an MUXR is closed, a source R becomes floating, and may be affected by adjacent source G and source B; when an MUXB is closed, a source B becomes floating, and may be affected by an adjacent source G; when an MUXG is opened at last, a source G may not be affected by adjacent source R and source B.

With the above input order of the trigger signals, the voltage jump directions of the source G and the source B adjacent to the source R are opposite and offset to each other, so the brightness of a sub-pixel pixel unit pixel R remains unchanged.

In conjunction with FIG. 5, the voltage jump directions of a source G3 and a source G4 adjacent to a source B3 are opposite and offset to each other, so the brightness of a pixel B3 remains unchanged. A source R4 and a source R5 adjacent to a source B4 become floating, and may not affect the source B4, so the brightness of a pixel B4 remains unchanged. The voltage jump direction of a source G1 adjacent to a source B1 is opposite to that of the source B 1, so the brightness of a pixel B1 is lowered, as shown in FIG. 8, indicated by a downward arrow corresponding to B1 in a column of an odd frame table. The voltage jump direction of the source G3 adjacent to a source B2 is the same as that of the source B1, so the brightness of a pixel B2 is increased, as shown in FIG. 8, indicated by an upward arrow corresponding to B2 in a column of the odd frame table.

Thus, the source G may not be affected by the adjacent source R and source B, the brightness of a pixel G remains unchanged.

Further, the data signals of the second type of frame of display image are input to the MUX signal input circuit, i.e., the data signals of the even frame of display image are input, and the trigger signals corresponding to sub-pixel units of different colors are input sequentially to the MUX signal input circuit according to the second color order, the second color order may be MUXG→MUXB→MUXR.

Based on the above input order, when the MUXG is closed, the source G becomes floating, and may be affected by the adjacent source R and source B; when the MUXB is closed, the source B becomes floating, and may be affected by the adjacent source R; when the MUXR is opened at last, the source R may not be affected by the adjacent source G and source B.

The voltage jump directions of the source R and the source B adjacent to the source G are opposite and offset to each other, so the brightness of the pixel G remains unchanged.

The source G3 and the source G4 adjacent to the source B3 become floating, and may not affect the source B3, so the brightness of the pixel B3 remains unchanged. The voltage jump directions of the source R4 and the source R5 adjacent to the source B4 are opposite and offset to each other, so the brightness of the pixel B4 remains unchanged. The voltage jump directions of the source R1 adjacent to the source B1 is the same as that of the source B1, so the brightness of the pixel B1 is increased, as shown in FIG. 8, indicated by an upward arrow corresponding to B1 in a column of an even frame table. The voltage jump directions of the source R3 adjacent to the source B2 is opposite to that of the source B2, so the brightness of the pixel B2 is lowered, as shown in FIG. 8, indicated by a downward arrow corresponding to B2 in a column of the even frame table.

The source R may not be affected by adjacent source G and source B, the brightness of the pixel R remains unchanged.

As shown in FIG. 8, when the odd frame and the even frame of image data is input, change directions of the brightness of the pixel B1 and the pixel B2 are opposite, so, from a user's perspective, the vertical Mura does not appear above the pixel B1 and the pixel B2 in the odd frame and the even frame, which improves the user's viewing experience.

According to the above principle, when the data is input, the brightness of the Pixel R/G/B may remain unchanged, so when the data lines on the display panel needs to be formed as a structure of being arranged around the preset pattern area according to FIG. 5, the order of positive, negative, positive, and negative according to which electrical signals on the plurality of signal lines are sequentially arranged is replaced with the order of positive, positive, negative and negative, in combination with the input order of trigger signals, the coupling capacitance of the signal lines may be offset to each other, thereby solving the problem that the coupling capacitance is large, which causes the vertical Mura.

By using the display panel and the display control method according to some embodiments of the present disclosure, the order of positive, negative, positive, and negative according to which electrical signals on the plurality of signal lines are sequentially arranged is replaced with the order of positive, positive, negative and negative, in combination with the input order of trigger signals, the coupling capacitance of the signal lines may be offset to each other, thereby solving the problem that when the spacing distance between the data lines is small, the coupling capacitance is large.

Of course, the solution of the present application may be extended to a case where one pixel unit includes any quantity of sub-pixel units. For example, one pixel unit includes four sub-pixel units of R, G, B, and X, and the X sub-pixel unit represents a white sub-pixel unit, when the spacing distance between the data lines is small, the coupling capacitance is large, the method of interchanging the connection orders between the sub-pixel units and the first signal lines and in combination with the input order of trigger signals may still be adopted to eliminate the coupling capacitance.

The embodiments described above are optional embodiments of the present disclosure, and it should be appreciated that a person skilled in the art may make various modifications and improvements without departing from the spirit and the scope of the present disclosure. The modifications and improvements shall also fall within the protection scope of the present disclosure.

What is claimed is:

1. A display panel, comprising a substrate, pixel units disposed on the substrate, and a plurality of signal lines, the display panel further comprising:

a time division multiplexing multiplexer (MUX) signal input circuit, which is connected with each of the plurality of signal lines, and configured to input data signals of each frame of display image to the plurality of signal lines, and for each frame of display image, input trigger signals corresponding to sub-pixel units of different colors to the plurality of signal lines in a time-sharing manner;

wherein, in response to each of the trigger signals and each of the data signals, an electrical signal on each of the plurality of signal lines is positive or negative, and among the plurality of signal lines, electrical signals on a plurality of adjacent first signal lines are arranged in sequence according to an order of positive, positive, negative and negative; wherein among the plurality of signal lines, a first signal line has a spacing distance from adjacent signal lines less than a preset value;

wherein the MUX signal input circuit comprises a plurality of signal output terminals arranged sequentially, and in response to each of the trigger signals and each of the data signals, voltages output by the plurality of signal output terminals arranged sequentially are positive or negative;

wherein, a plurality of first signal lines are connected with the plurality of signal output terminals one by one, and by connecting each of the plurality of first signal lines with a corresponding signal output terminal, electrical signals on the plurality of adjacent first signal lines are arranged in sequence according to an order of positive, positive, negative and negative.

2. The display panel according to claim 1, wherein the MUX signal input circuit is configured to input the data signals of a first type of frame of display image to the plurality of signal lines, and input the trigger signals corresponding to sub-pixel units of different colors to the plurality of signal lines in sequence according to a first color order; and the MUX signal input circuit is further configured to input the data signals of a second type of frame of display image to the plurality of signal lines, and input the trigger signals corresponding to sub-pixel units of different colors to the plurality of signal lines in sequence according to a second color order;

wherein, the second type of frame of display image is a frame of image adjacent to the first type of frame of display image, and the first color order is different from the second color order.

3. The display panel according to claim 1, wherein at least a portion of the plurality of first signal lines are in a curved shape.

4. The display panel according to claim 3, wherein the plurality of first signal lines in the curved shape are sequentially arranged around a periphery of a preset pattern area of the substrate, wherein the pixel units are disposed on an area outside the preset pattern area on the substrate.

5. The display panel according to claim 3, wherein each of the plurality of first signal lines in the curved shape comprises a first line portion in an arc shape and a second line portion in a straight line connected with the first line portion.

6. The display panel according to claim 1, wherein a quantity of the plurality of first signal lines is an integral multiple of 12.

7. The display panel according to claim 6, wherein for every 12 adjacent first signal lines among the plurality of first signal lines, corresponding colors of the sub-pixel units connected with the 12 adjacent first signal lines are arranged in an order of a first color, a second color, a third color, the first color, the third color, the first color, the second color, the third color, the second color, the third color, the first color, and the second color.

8. The display panel according to claim 7, wherein the first color is red, the second color is blue and the third color is green.

9. The display panel according to claim 5, wherein the first line portions of two adjacent first signal lines are parallel to each other, and the second line portions of two adjacent first signal lines are parallel to each other, and a vertical distance between the two adjacent first line portions is smaller than a vertical distance between the two adjacent second line portions.

10. The display panel according to claim 1, wherein the MUX signal input circuit comprises:

a plurality of switch transistors, wherein a first electrode of each of the plurality of switch transistors forms a signal output terminal of the MUX signal input circuit, and a second electrode of each of the plurality of switch transistors is connected with a data line; and a plurality of MUX signal lines, wherein each of the plurality of MUX signal lines corresponds to a sub-pixel unit of one color, and is connected with a control terminal of one of the plurality of switch transistors; wherein a trigger signal is input through a MUX signal line, a switch transistor connected with the MUX signal line is turned on to form a conductive connection between the first electrode and the second electrode of the switch transistor, the data signal input through the data line is transmitted to the signal output terminal of the MUX signal input circuit, so that the electrical signal on the signal line connected with the signal output terminal of the MUX signal input circuit 1*s* positive or negative.

11. The display panel according to claim 10, wherein the data lines comprises a first data line and a second data line, the second electrodes of a portion of the switch transistors are connected with the first data line, and the second electrodes of the other portion of the switch transistors are connected with the second data line;

wherein, when the data signals of each frame of display image are input through the data lines, one of the first data line and the second data line is positive, and the other of the first data line and the second data line is negative.

12. The display panel according to claim 1, wherein the signal lines comprise a plurality of second signal lines, in response to each of the trigger signals and each of the data signals, electrical signals on the plurality of adjacent second signal lines are arranged in sequence according to an order of positive, negative, positive and negative.

13. The display panel according to claim 1, wherein the substrate is further provided with a plurality of third signal lines;

wherein an input terminal of each of the plurality of first signal lines is connected with the MUX signal input circuit, and output terminals of the plurality of first signal lines are connected with the plurality of third signal lines one by one; and by connecting the output terminal of each of the plurality of first signal lines with a corresponding third signal line, electrical signals on the plurality of adjacent third signal lines are arranged in sequence according to an order of positive, negative, positive and negative.

14. A display device, comprising the display panel according to claim 1.

15. A display control method for a display device, applied to the display device according to claim 14, the method comprising:

inputting the data signals of a first type of frame of display image to the MUX signal input circuit, and inputting the trigger signals corresponding to sub-pixel units of different colors in sequence to the MUX signal input circuit according to a first color order;

inputting the data signals of a second type of frame of display image to the MUX signal input circuit, and inputting the trigger signals corresponding to sub-pixel units of different colors in sequence to the MUX signal input circuit according to a second color order;

wherein, the second type of frame of display image is a frame of image adjacent to the first type of frame of display image, and the first color order is different from the second color order.

16. The display control method according to claim 15, wherein the first color order is red, blue, and green, and the second color order is green, blue, and red.

* * * * *